US010352326B2

(12) United States Patent
Gillant et al.

(10) Patent No.: US 10,352,326 B2
(45) Date of Patent: Jul. 16, 2019

(54) ASSEMBLY FOR AN ENGINE WHICH CAN DEFINE A BLADE BREAK-OFF TEST DEVICE

(71) Applicant: Snecma, Paris (FR)

(72) Inventors: Grégory Nicolas Gérald Gillant, Moissy-Cramayel (FR); Aline Bourdais, Moissy-Cramayel (FR); Olivier Lefebvre, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 393 days.

(21) Appl. No.: 15/157,187

(22) Filed: May 17, 2016

(65) Prior Publication Data

US 2016/0341205 A1 Nov. 24, 2016

(30) Foreign Application Priority Data

May 19, 2015 (FR) ..... 15 54493

(51) Int. Cl.

| | |
|---|---|
| ***F01D 21/00*** | (2006.01) |
| ***F01D 21/04*** | (2006.01) |
| ***F01D 25/16*** | (2006.01) |
| ***F04D 27/00*** | (2006.01) |
| ***F04D 29/08*** | (2006.01) |
| ***F04D 29/32*** | (2006.01) |
| ***F04D 29/38*** | (2006.01) |
| ***F04D 29/52*** | (2006.01) |

(52) U.S. Cl.

CPC ..... *F04D 27/001* (2013.01); *F01D 21/003* (2013.01); *F01D 21/045* (2013.01); *F01D 25/164* (2013.01); *F04D 29/083* (2013.01); *F04D 29/325* (2013.01); *F04D 29/38* (2013.01); *F04D 29/522* (2013.01); *F05D 2220/36* (2013.01); *F05D 2260/83* (2013.01)

(58) Field of Classification Search

CPC ..... F01D 21/003; F01D 21/045; F01D 25/16; F01D 25/162; F01D 25/164; F01D 25/28; F01D 25/285; F01D 5/026; F05D 2260/83

USPC ..... 336/115, 117, 118, 119, 130, 131, 132

See application file for complete search history.

(56) References Cited

U.S. PATENT DOCUMENTS 5,572,178 A * 11/1996 Becker ..... H01F 38/18 336/120
2008/0152483 A1* 6/2008 Godleski ..... F01D 25/164 415/142

(Continued)

FOREIGN PATENT DOCUMENTS

EP 1 413 822 A1 4/2004
EP 2 149 681 A2 2/2010

*Primary Examiner* — Richard A Edgar
*Assistant Examiner* — Elton K Wong
(74) *Attorney, Agent, or Firm* — Blank Rome LLP

(57) ABSTRACT

The invention relates to an assembly on an engine, which comprises a first and a second piece mounted so as to rotate relative to one another. A connecting device is provided between such pieces. It comprises a first annular part defining a flange fixed to the first piece a second annular part extending substantially parallel with the axis of rotation of the engine and studs connecting the first and second annular parts together. An interface for the rotational sliding about said axis is positioned between the second annular part and the second piece. The second annular part is sectorized.

19 Claims, 3 Drawing Sheets

(56) References Cited

U.S. PATENT DOCUMENTS

2010/0158693 A1* 6/2010 Viegas ..... F01D 5/282
416/223 R
2014/0105727 A1* 4/2014 Rousselin ..... F01D 21/003
415/118

* cited by examiner

ASSEMBLY FOR AN ENGINE WHICH CAN DEFINE A BLADE BREAK-OFF TEST DEVICE

BACKGROUND OF THE INVENTION

The present invention relates to the field of an assembly for an engine, more particularly a turbine engine, and more specifically a turbojet engine or a turboprop engine for an airplane, between a first and a second piece mounted so as to rotate relative to each other about the axis of rotation of an engine.

Such an assembly is already known which comprises:

said first and second pieces, a device for connecting such first and second pieces, with such connecting device comprising:

a first annular part extending globally radially relative to said axis and defining a flange attached to the first piece, and a second annular part extending globally parallel with said axis of rotation of the engine, curved studs connecting the first and second annular parts together, and an interface for rotational sliding about said axis, positioned between the second annular part and the second piece.

A problem arises for connecting the first and second pieces, with said connection making it possible to compensate for any axial misalignment between such pieces. The first piece may be misaligned relative to the second piece. High stresses may then be generated which might entail damage or a greater fatigue.

SUMMARY OF THE INVENTION

A solution as proposed consists in that:

the second annular part of the connecting device is sectorized, so that each sector is individualized relative to the adjacent sector and has a free end, and the studs each have, substantially from the curving, a part globally oriented parallel to the axis of rotation of the engine and having a section which laterally widens towards the second annular part, and/or, circumferentially about the axis of rotation, each stud and each sector of the second annular part respectively have a first width and a second width, with the second width being greater than the first width.

Giving radial flexibility to the axis of rotation of the engine will make it possible to compensate for any axial misalignment, as mentioned above.

This may more particularly be used if bearing connections are provided for.

The above-mentioned sliding interface of the assembly is provided to comprise a mechanical bearing inserted between the second annular part and the second piece.

An assembly such as above-mentioned may also, more particularly, define a turbo-shaft engine fan blade break-off test device, it being recalled that, in a turbofan engine, the fan is the first stage of the compressor and can be compared to a ducted propeller provided with blades rotating about the axis of rotation of the engine.

As a matter of fact, when developing a turbine engine, making a complete engine fan blade break-off test may be necessary to be able to certify the authorities that the engine will resist such possible scenario.

The engine must typically be modified before executing such test, in order to:

incorporate a firing device (such as a detonator) onto one blade of the fan, incorporate a system for supplying the firing device with electricity.

A fan blade break-off test device is already known when the turbine engine comprises a stationary sealing flange and a fan disc rotating about an axis of rotation of the engine and which the blade is attached to.

When applied to a test device, the assembly comprises:

a firing system to be positioned on the fan blade, a first winding electrically supplied from an electric source and fixed to the second annular part, a second winding fixed to the rotor disc (present as the so-called «second», then mobile one), electrically connected to the firing system and which electric energy is transmitted to, through an inductive coupling with the first winding, and a connecting device, of the type mentioned above provided between the rotor disc and preferably a sealing flange (as the so-called «first piece», then stationary one), with the connecting device thus comprising:

a first annular part extending globally radially relative to said axis and defining a flange to be attached to the sealing flange, and a second annular part extending globally parallel with said axis of rotation of the engine, and which the first winding is attached to, and curved studs connecting the first and second annular parts together.

One problem involved in this technology lies in the coupling of the studs deformations since these are all connected together by an annular part. As a matter of fact, for instance, when the rotor moves and comes into contact with the 12:00 stator (here the sealing flange mentioned above), it being specified that this indication is an hour angle orientation when looking in the upstream direction, a 12:00 stud is subjected to a purely radial deformation whereas the 09:00 and 03:00 studs are subjected to purely tangential deformations. Radial and tangential components are coupled between these two points. Such coupling may generate too high constraints for the mounting to resist.

Again, a solution as proposed consists in sectorizing the second annular part.

As mentioned above, providing such a "flexible cage" materialized by such sectorization and studs must make it possible to reach the expected radial flexibility.

Without such sectorization, i.e. beforehand, the constraints involved in the radial and tangential deformations on the studs sectors were not taken into account in two separated stages. The solution provided now makes it possible not to take into account such involvement and thus to comply with dimensions criteria.

The stresses and constraints will thus be able to correctly transit and be supported more particularly on the second sectorized annular part side, with the operational requirements.

Thus conformed to the blade break-off test device, the studs with optimized profiles will best reach the objective of no radial and tangential coupling.

Another objective to be reached within this context consists in having a really flexible mounting so that it will not hinder the natural displacements of the concerned engine parts.

This is a reason why having each sector of the second annular part connected to a single stud is provided for.

This should enable the studs to operate independently, instead of having all the studs operate if there is no sectorizing.

Another aspect considered here relates to the search for a solution enabling integration without significantly modifying the surrounding parts of the engine.

This is a reason why, as the fan disc has a pin-shaped radial section defining an inner space, positioning the connecting device in such inner space is provided for.

BRIEF DESCRIPTION OF THE DRAWINGS

Other characteristics and advantages may still appear upon reading the following description, while referring to the appended drawings, in which.

DETAILED DESCRIPTION OF THE PREFERRED EMBODIMENTS

Figure 1:
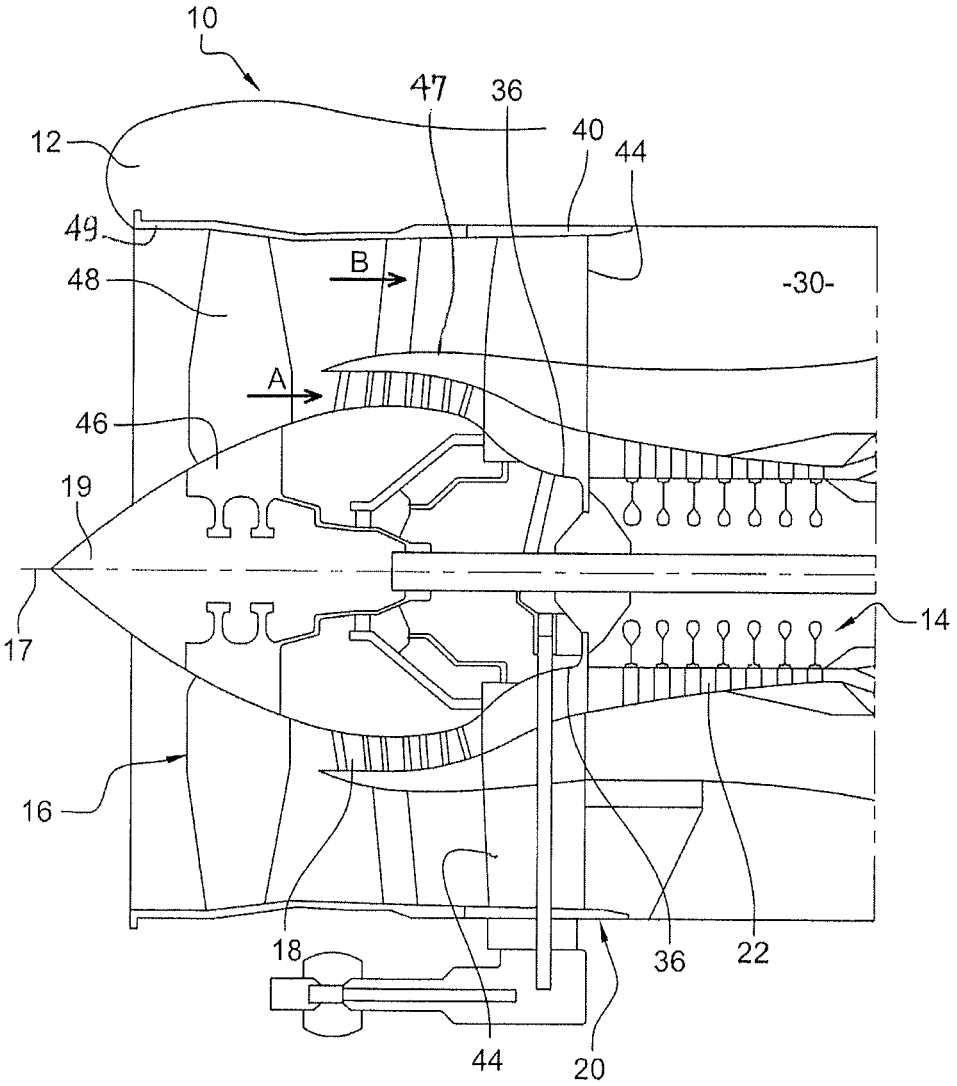
FIG. 1 is a partial schematic view in axial median section of a part of a turbofan inlet.

FIG. 1 shows the front (or the upstream part) of a turbofan engine 10 comprising a substantially cylindrical nacelle 12 which surrounds a turbojet engine 14 and an impeller 16 mounted upstream of the turbojet engine 14, which mainly comprises, in the downstream direction (AM/AV) and, as shown, a low pressure compressor 18, an intermediate casing 20, a high pressure compressor 22, as well as a combustion chamber, a turbine and an exhaust casing, not shown.

In operation, the impeller 16, driven by the turbine about the engine central axis 17, sucks up airflow which is divided into a primary air flow (A arrow) which goes through the turbojet engine and a secondary air flow (B arrow; jet 30) which surrounds it.

The intermediate casing 20 comprises two co-axial, respectively inner 36 and outer 40 collars (along a direction axial to the axis 17) which are positioned one inside the other, and connected by radial arms 44.

The intermediate casing 20 further comprises an intermediate collar 47 arranged radially relative to the axis 17 between the inner 36 and the outer 40 collars and gone through by the radial arms 44.

As regards the impeller 16, it comprises a disc 46 bearing radial blades 48 around which the fan casing 49 is placed, at the nacelle 12, upstream of the outer collar 40. The radial blades 48 extend just downstream of the inlet cone 19.

Figure 2:
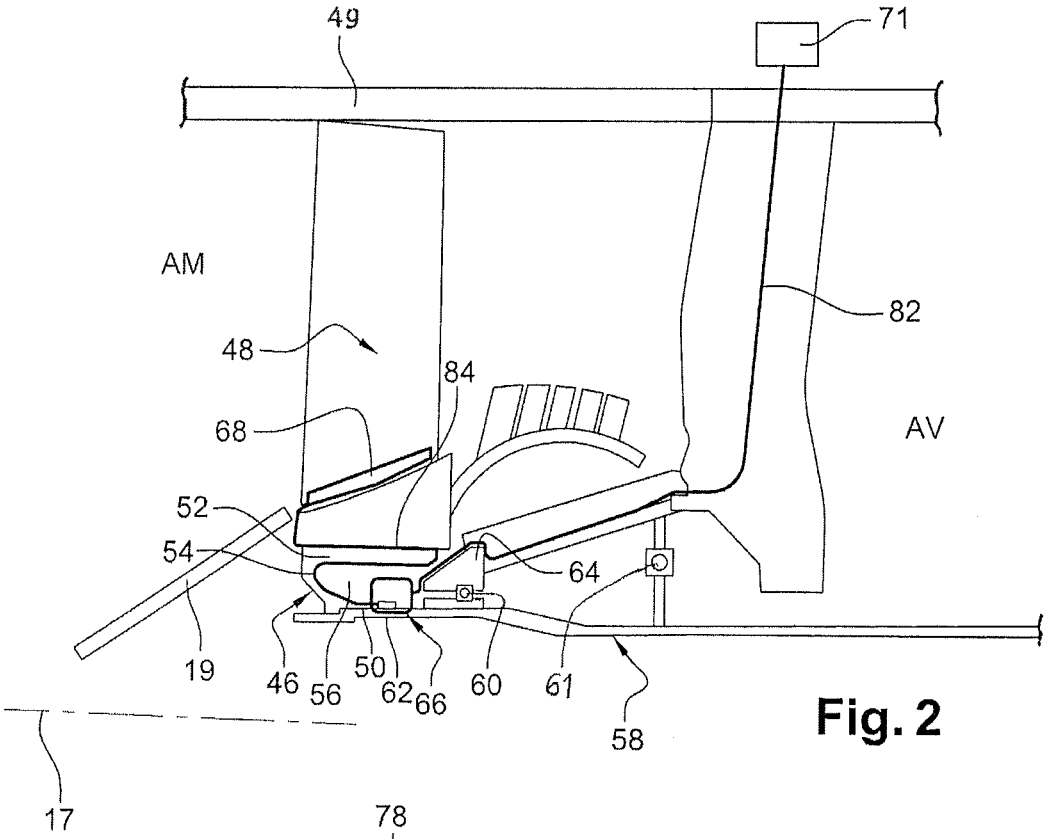
FIG. 2 is an enlarged local view of a part of FIG. 1.

In a recent embodiment illustrated in FIG. 2, the disc 46 has a pin-shaped radial section opening downstream and defined with a radially internal lug 50 and a radially external part 52 connected together by a junction wall 54 so as to define an inner space 56.

The fan disc 46 is supported by the drive shaft 58 of the low pressure compressor intended to drive the impeller 16 into rotation about the axis 17. The drive shaft 58 is centered on the axis 17 and is radially guided and axially held by a series of bearings, specifically a first bearing 60 positioned close to the upstream end of such shaft 58 and a second bearing 61 which acts here as a thrust bearing.

The radially inner lug 50 comprises an inner collar centered on the axis 17 and the inner face of which is adapted to be fixed onto an upstream free end 62 of the drive shaft 58.

A flange 64 solidly extends up to upstream of the first bearing 60 and around it, so as to secure the sealing thereof.

As the development of engines requires the execution of complete engine blade break-off tests, so as to check the behaviour thereof in such case, FIG. 2 also shows the presence of an engine fan blade break-off test device 66.

Figure 3:
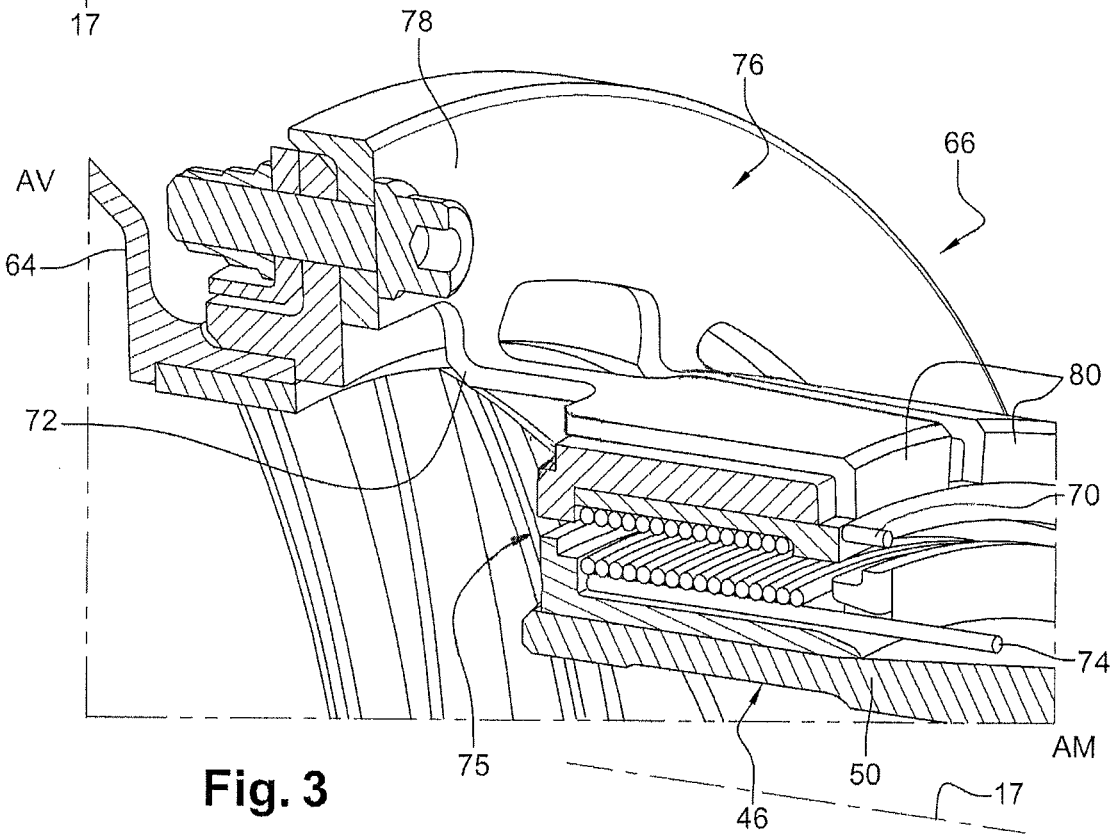
FIG. 3 is a sectional view of a fan blade break-off test device according to the invention.

As can be seen when associating FIGS. 2 and 3, the device 66 comprises:

- a firing system 68 positioned on (fixed to) the fan blade to be tested, here blade 48,
- a first electric winding 70 power-supplied from an external electrical source 71,
- a second electric winding 74 fixed to the rotor disc 46, electrically connected to the firing system 68 and which electric energy is transmitted to, through an inductive coupling with the first winding 70.
- and a connecting device 76 provided between the rotor disc and the sealing flange 64 for holding purposes and for transmitting adapted stresses.

When slightly radially away from each other, the first and second windings 70, 74 define an interface 75 for the rotational sliding about the axis 17, between the rotor part and the stator part.

As for the connecting device 76, it comprises:

- a first annular part 78 extending substantially radially relative to said axis 17 and defining a flange to be attached to the sealing flange 64,
- a second annular part 80 extending substantially parallel with said axis of rotation 17 of the engine, and which the first winding 70 is attached to, and
- curved studs 72 connecting the first and second annular parts 78, 80 together, The connecting device 76 then becomes an intermediary between the sealing flange 64 and the annular part 80.

As explained above, a problem involved in such solution using studs lies in the coupling of the stud deformations, since the ring 78 connects them all, as would the ring 80, if continuous, as the ring 78 is. In this case, if the rotor (the disc 46) moves and comes into contact with the stator (here the flange 64) located at 12:00, the 12:00 stud would be subjected to a purely radial deformation whereas the 09:00 and 03:00 studs would be subjected to purely tangential deformations. Radial and tangential components would be coupled between these two points, with such coupling generating excessive constraints as regards the behaviour of the system.

Figure 4:
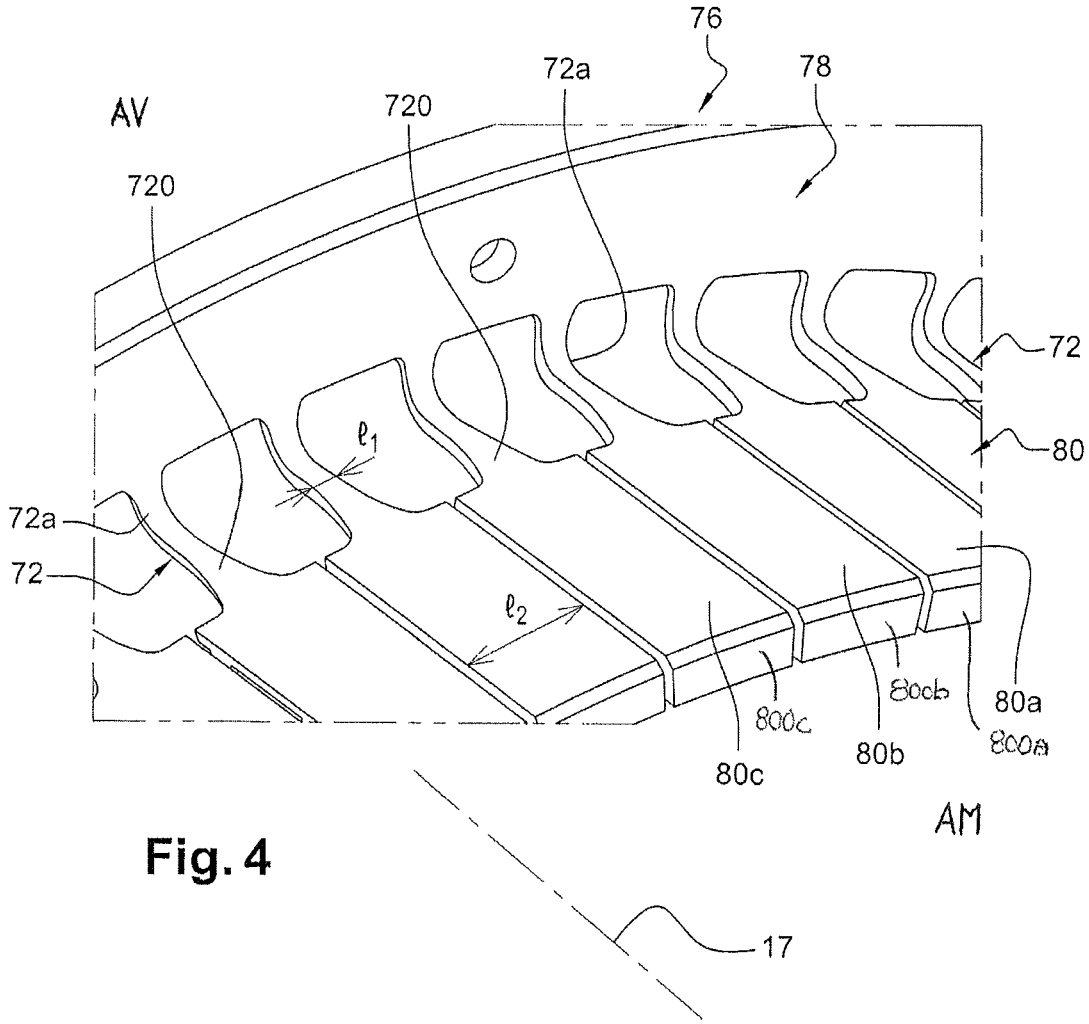
FIG. 4 is an enlarged local view of FIG. 3.

Sectorizing the second annular part 80, as more clearly illustrated in FIG. 4, avoids such coupling.

Such second annular part 80 thus comprises a series of angular sectors such as 80*a*, 80*b*, 80*c*, with each one being individualized from the adjacent sector and having a free end, respectively 800*a*, 800*b*, 800*c*. Such free end is located opposite the stud 72 extended by such sector.

The sectors, such as 80*a*, 80*b*, 80*c*, are circumferentially positioned one after the other about the axis 17.

The 09:00 and 03:00 studs will thus no longer be driven by the ring upon the 12.00 rotor/stator contact. Each stud will then be subjected to radial deformations only. The part 80 now forms a sectorized ring, each sector of which operates independently of the others, like keys in a piano.

To resist the bending stresses resulting from the radial stresses and sustainably get rid of the constraints, it is further recommended, as shown in FIG. 4 (where the upstream direction AM is on the right):

for the studs 72 to have, each, substantially from the curving 72*a*, a part 720 globally oriented parallel to the axis of rotation 17 of the engine and to have a section which laterally widens towards the second annular part 80, and, whenever possible in combination, circumferentially about the axis of rotation 17, for each stud 72 and each sector of the second annular part 80 respectively to have a first width l1 and a second width l2, with the second width l2 being greater than the first width l1.

Such widths l1, l2 will preferably be in the same plane.

While referring to FIG. 3 again, it should be noted that the first winding 70 is attached to the second sectorized annular part 80 and that the second winding 74 is attached to the disc 50. Gluing may be adapted. A radial proximity between the windings 70, 74 of 2 mm maximum is recommended to guarantee the inductive coupling, i.e. a current supply of the transformer type.

Referring now to FIG. 2, it should be noted that the connecting device is positioned in the inner space 56, opened in the downstream direction.

This results from the type of current supply selected.

Among the criteria taken into account while selecting the above mounting, it should be noted that:

the power supply must enable the electric supply of the firing system positioned on the blade 48.—the system 68 is thus mounted to rotate;

the supply system must not interfere with the engine motions in the series configuration;

the supply system must be incorporated while modifying as few engine parts as possible;

the rotor/stator displacements on the series engine are major ones in the considered mounting; but mounting the system somewhere else in the motor revealed rather complicated because of too high temperatures in the other zones;

the connecting device must not break, neither during the test phases nor during the preliminary phases (balancing, test with a major unbalance, running in . . . ).

FIG. 2 shows that cables 82, 84 make it possible to connect the electric source 71 of the bench with the first winding 70 and the second winding 74 with the detonator 68 respectively.

In the mounting area 56, relative rotor/stator radial displacements of about 3 mm may occur which shall be supported by the system. The above-mentioned sectorization must provide the radial flexibility enabling them to resist these.

In such application of an inductive coupling with the mounting mentioned above, it is further recommended for each sector of the second annular part 80 to be connected to a single stud 72, as shown in FIG. 4. A division by seven of the constraints could be noted relative to a solution as shown in FIG. 3, but with a not sectorized part 80, which is just notched parallel to the axis 17.

It should also be noted that the above-mentioned sectorization principle can be extended to other applications in the engine, such as the mounting of a bearing instead of the two windings 70, 74.

Figure 5:
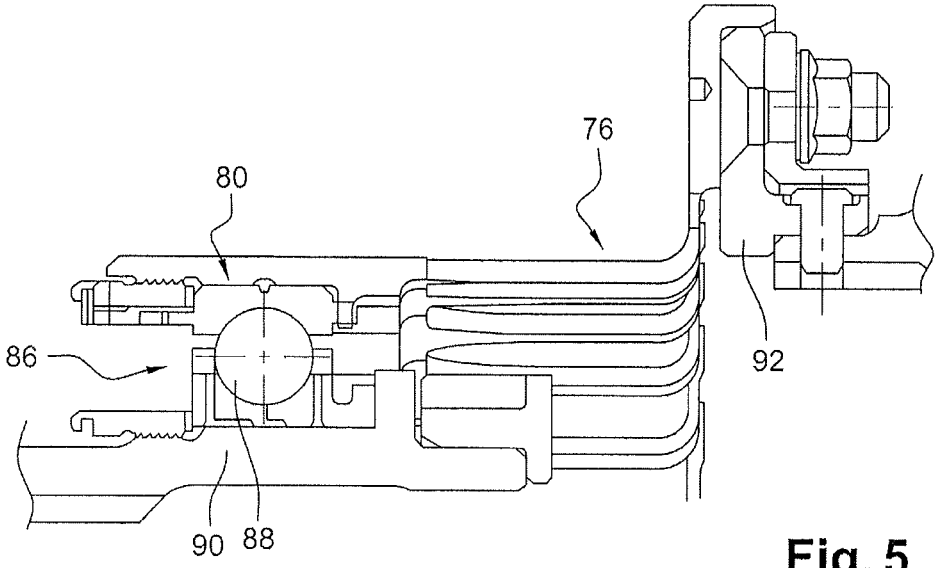
FIG. 5 shows an alternative embodiment of the solution of FIGS. 2-4, in the case of a bearing mounting.

It can thus be seen in FIG. 5 that the interface 86 for the rotational sliding comprises a mechanical bearing 88 inserted between the second annular part 80 and the piece 90 (so-called the second piece, hereabove), instead of the windings. Such piece 90 could be the disc 46.

A rotor/stator connection, here respectively the piece 90 and the piece 92 which the connecting device 76 is attached to, is thus produced with radial flexibility making it possible to compensate for any axial misalignment.

What is claimed is:

1. An assembly provided on an engine, the assembly comprising:

a first and a second piece so mounted as to rotate relative to each other about an axis of rotation of the engine, a connecting device for connecting said first and second pieces, with such connecting device comprising:

a first annular part extending substantially radially relative to said axis and defining a flange attached to the first piece, and a second annular part extending substantially parallel with said axis of rotation of the engine, and curved studs connecting the first and second annular parts together, and an interface for the rotational sliding about said axis, positioned between the second annular part and the second piece, wherein:

the second annular part of the connecting device is sectorized, each of the curved studs has a part extending from a curved portion of the curved stud along a direction oriented parallel to the axis of rotation of the engine, said part having a section which laterally widens towards the second annular part, and each sector of the second annular part is connected to one single stud of said curved studs.

2. The assembly according to claim 1, wherein the second piece is a fan disc which blades are attached to.

3. The assembly according to claim 2, wherein the fan disc, which rotates about said axis of rotation of the engine, has a U-shaped radial section defined by a radially internal lug and a radially external, lug connected together by a junction wall so as to define an inner space wherein the connecting device is positioned.

4. The assembly according to claim 2, defining a turbo-shaft engine fan blade break-off test device, and wherein:

a firing system is positioned on the fan blade to be tested, and the interface for the rotational sliding about said axis comprises:

a first winding electrically supplied from an electric source and fixed to the second annular part, and a second winding fixed to the fan disc, electrically connected to the firing system and which electric energy is transmitted to, through an inductive coupling with the first winding.

5. The assembly according to claim 1, wherein the interface for the rotational sliding about said axis, comprises a mechanical bearing inserted between the second annular part and the second piece.

6. The assembly according to claim 1, wherein all the sectors are identically connected to the first annular part.

7. The assembly according to claim 1, wherein the first piece is a stationary sealing flange.

8. The assembly according to claim 1, wherein, circumferentially about the axis of rotation, each curved stud and each sector of the second annular part respectively have a first width and a second width, with the second width being greater than the first width.

9. The assembly according to claim 1, wherein the curved studs comprise single studs only.

10. An assembly defining a turbo-shaft engine fan blade break-off test device, wherein:

the assembly comprises:

a first and a second piece so mounted as to rotate relative to each other about an axis of rotation of the engine, a connecting device for connecting said first and second pieces, with such connecting device comprising:

a first annular part extending substantially radially relative to said axis and defining a flange attached to the first piece, a second annular part extending substantially parallel with said axis of rotation of the engine, and curved studs connecting the first and second annular parts together, and an interface for the rotational sliding about said axis, positioned between the second annular part and the second piece, and wherein:

the second annular part of the connecting device is sectorized, a firing system is positioned on the fan blade to be tested, and each sector of the second annular part is connected to one single stud of said curved studs.

11. The assembly according to claim 10, wherein the interface for the rotational sliding about said axis comprises:

a first winding electrically supplied from an electric source and fixed to the second annular part, a second winding fixed to the fan disc, electrically connected to the firing system and which electric energy is transmitted to, through an inductive coupling with the first winding.

12. The assembly according to claim 10, wherein each sector is individualized relative to the adjacent sector and has a free end.

13. An assembly provided on an engine, the assembly comprising:

a first and a second piece so mounted as to rotate relative to each other about an axis of rotation of the engine, a connecting device for connecting said first and second pieces, with such connecting device comprising:

a first annular part extending substantially radially relative to said axis and defining a flange attached to the first piece, a second annular part extending substantially parallel with said axis of rotation of the engine, and curved studs connecting the first and second annular parts together, and an interface for the rotational sliding about said axis, positioned between the second annular part and the second piece, wherein:

the second annular part of the connecting device is sectorized, so that it comprises sectors, each of which has a tree end and is individualized from an adjacent sector of said sectorized connecting device, and each of the studs has a part extending from a curved portion of the stud along a direction oriented parallel to the axis of rotation of the engine, said part having a section which laterally widens towards the second annular part.

14. The assembly according to claim 13, wherein, circumferentially about the axis of rotation, each curved stud and each sector of the second annular part respectively have a first width and a second width, with the second width being greater than the first width.

15. The assembly according to claim 13, wherein the curved studs comprise single studs only.

16. The assembly according to claim 13, wherein the second piece is a fan disc which blades are attached to.

17. The assembly according to claim 13, wherein the interface for the rotational sliding about said axis, comprises a mechanical bearing inserted between the second annular part and the second piece.

18. The assembly according to claim 13, wherein all the sectors are identically connected to the first annular part.

19. The assembly according to claim 13, wherein the first piece is a stationary sealing flange.

* * * * *